US005542156A

United States Patent [19]

Oglesby

[11] Patent Number: 5,542,156

[45] Date of Patent: Aug. 6, 1996

[54] TROUSER LEG RETAINING DEVICE

[76] Inventor: Larry W. Oglesby, Rte. 2, Box 217A, Whiteville, N.C. 28472

[21] Appl. No.: 299,440

[22] Filed: Sep. 1, 1994

[51] Int. Cl.[6] ..... A41F 17/04

[52] U.S. Cl. ..... 24/72.1; 2/233; 24/299; 24/301

[58] Field of Search ..... 2/231–233; 24/72.1, 24/298–302, 299, 301; 36/1.5, 71.5

[56] References Cited

U.S. PATENT DOCUMENTS

| | | | |
|---|---|---|---|
| 40,931 | 12/1863 | Heller | 24/72.1 |
| 595,564 | 12/1897 | Garrigus | 29/299 X |
| 792,677 | 6/1905 | Stowell | 24/299 X |
| 1,340,276 | 5/1920 | Koehne | 2/223 |
| 4,115,906 | 9/1978 | Lavine et al. | 2/233 X |
| 4,941,213 | 7/1990 | Grilliot et al. | 2/232 X |

*Primary Examiner*—James R. Brittain

[57] ABSTRACT

A restraining device for trouser legs provides ornamentation and includes a central elastic strap to which link chains are affixed at each end. Folded elastic fabric end segments are attached at opposite ends of the link chains and a conventional snap fastener is securely affixed to the elastic end segments. Mating snap fasteners are also affixed interiorly to the inside and outside of each trouser leg to engage the fasteners of the end segments. The restraining device is placed across the sole or bottom of a boot or shoe so when the wearer's knee is bent, and the pant legs moves up the wearer's leg as a result, the restraining device resiliently urges the leg of the trousers to return to its fully extended or normal position against the boot or shoe. Decorative charms are joined to excess lengths of the chains as desired by the wearer.

11 Claims, 2 Drawing Sheets

TROUSER LEG RETAINING DEVICE

BACKGROUND OF THE INVENTION

1. Field of the Invention

The invention herein pertains to trouser leg restraining devices and particularly to ornamental trouser restraining devices which are resilient and are connected to the ends of trouser legs and pass beneath the shoe sole of the wearer.

2. Description of the Prior Art and Objectives of the Invention

Various types of straps and holders have been used in the past to maintain trouser legs in a fully extended posture, proximate the shoe tops of the wearer. Such devices are shown in U.S. Pat. Nos. 40,931, 397,968, 43,727 414,730 and more recently, 4,115,906. While such prior art devices retain the trouser legs under normal conditions, a more secure, decorative retaining device for jeans and cowboy boots has been warranted for adverse use conditions, as may occur when riding a motorcycle and working on a western ranch. For example, motorcycle riders oftentimes place their shoes or boots in contact with hot motorcycle parts such as the engine and exhaust system which can burn or destroy most fabrics. Fabric will also wear quick when kept in contact with the vibrating parts of a running motorcycle. Likewise when working in the harsh environment of a western ranch most fabrics would wear quickly.

Thus, with the disadvantages of fabric and other prior art restraining devices, the present invention was conceived and one of its objectives is to provide a trouser leg retaining device which can be used in combination with suitably adapted trousers or pants.

It is another objective of the present invention to provide a trouser leg retaining device which includes a metal chain that is suitable for adverse use conditions.

It is still another objective of the present invention to provide a decorative trouser leg retaining device which includes snap fasteners at each end for engaging snap fasteners placed on the interior of trouser legs.

It is also an objective of the present invention to provide a trouser leg retaining device which is quick and simple to attach yet which will resiliently restrain the trouser legs in a fully extended posture and provides for selective charm display.

It is also an objective of the present invention to provide a trouser leg retaining device having a means for length adjustment on each side of the boot or shoe.

SUMMARY OF THE INVENTION

The invention herein pertains to a restraining device for trouser legs which can be used in conditions which are less than desirable. The device includes a pair of link chains having an excess length which are attached to a central elastic strap. The opposite ends of the chains are joined to lanyard hooks which may be the swivel type for attachment to openable key ring fasteners which in turn are connected to elastic end segments which contain a fastener such as a conventional fabric snap. Snaps are also positioned on the interior of the pant legs whereby the snaps on the elastic end segments can be coupled thereto and the restraining device fastened across the bottom of the shoe or boot to securely hold and retain the pant legs. Metal decorative charms such as horseshoes, boots or other designs can be affixed to the end of the excess link chain to identify club memberships, interests of the wearer or for aesthetic purposes.

DETAILED DESCRIPTION OF THE PREFERRED EMBODIMENT AND DRAWING FIGURES

Figures 1, 2:
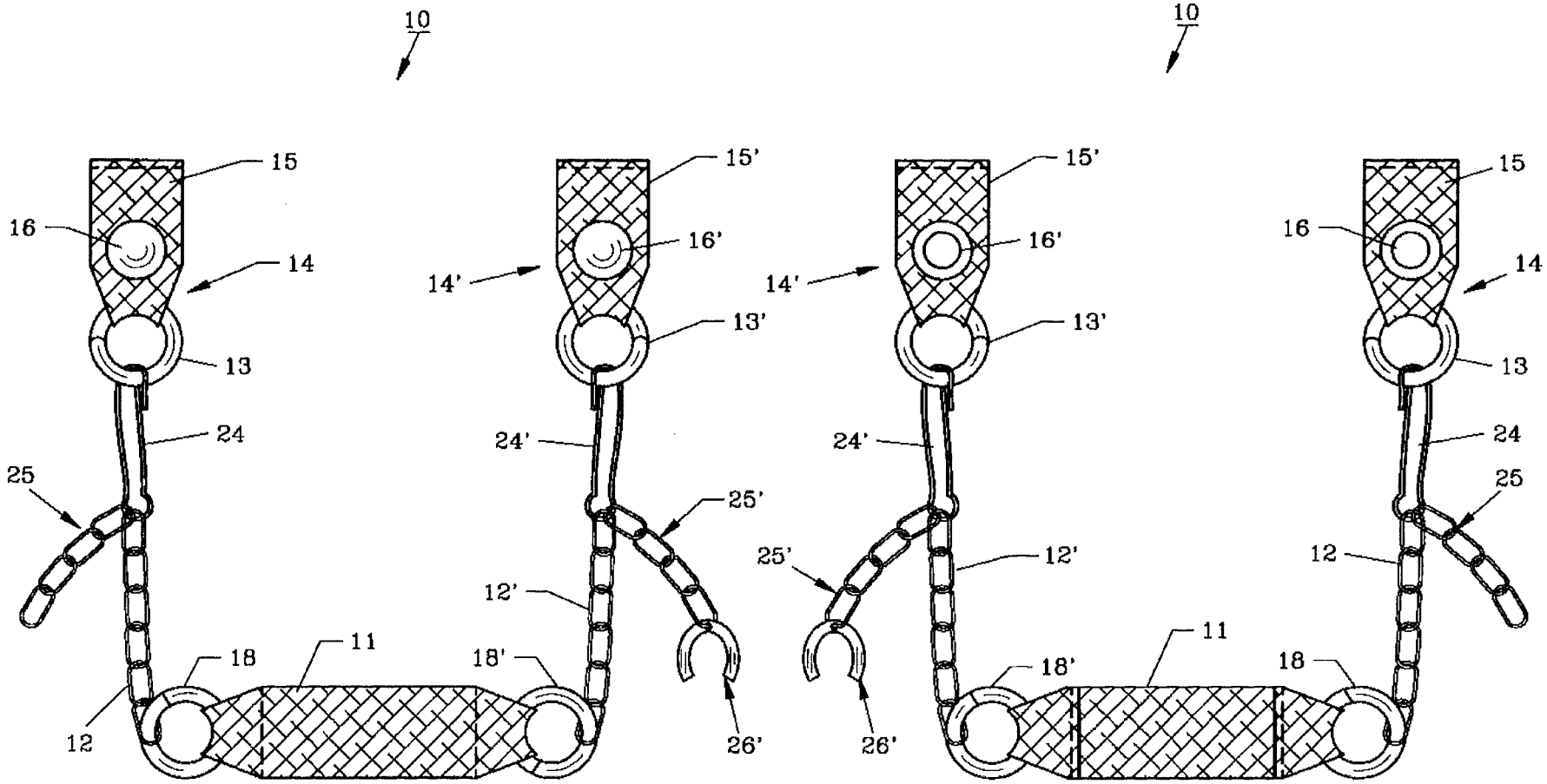
FIG. 1 illustrates a top plan view of the trouser restraining device of the invention.
FIG. 2 shows a bottom plan view of the restraining device as seen in FIG. 1.
Figure 3:
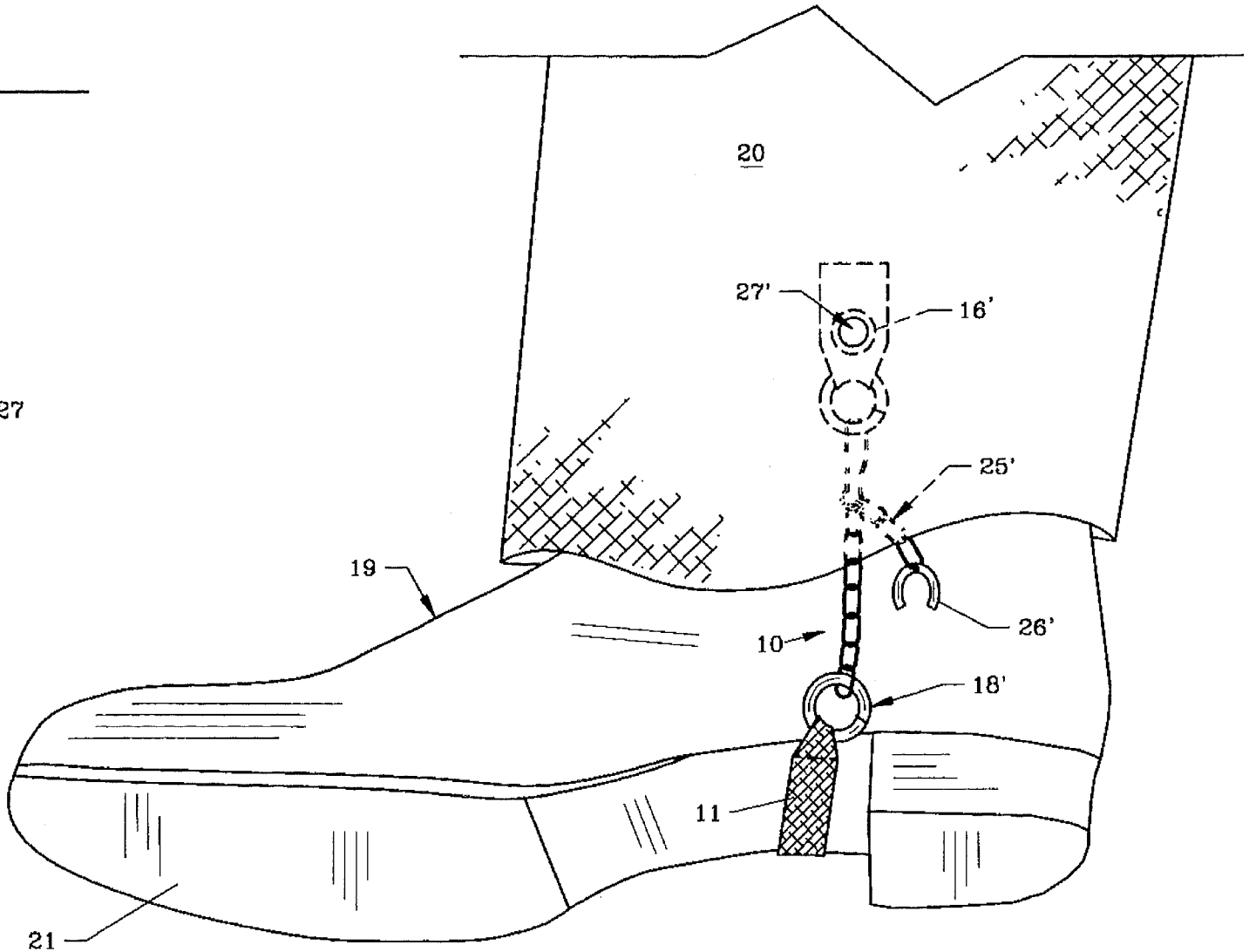
FIG. 3 demonstrates the restraining device as attached to the outside of the left leg of a wearer.

For a better understanding of the invention and its operation, turning now to the drawings, FIGS. 1–3 illustrate the preferred form of the invention with trouser leg restraining strap 10 seen in FIG. 1 which includes a central elastic strap 11 which may be formed from a resilient fabric containing rubber or other elastomeric yarns. Affixed to each end of elastic strap 11 are openable key ring fasteners 18, 18' which in turn are connected with link chain members 12, 12' which may be relatively short, having a length of approximately two to four inches each. Link chains 12, 12' may be of the designer link chain type. Link chains 12, 12' connect by means of laynard hooks 24, 24' to openable key ring connectors 13, 13' which pass through loops 14, 14' formed by folded fabric end segments 15, 15'. The double elastic fabric used as in central strap 11 adds strength and support for ring connectors 13, 13'. FIG. 2 demonstrates a bottom view of the restraining device 10 as shown in FIG. 1 to clearly show the reverse or back side thereof. Laynard hooks 24, 24' join link chains 12, 12' respectively to key ring connectors 13, 13'. Excess chain length 25, 25' provide a means to suspend and display charms 26'.

Figure 4:
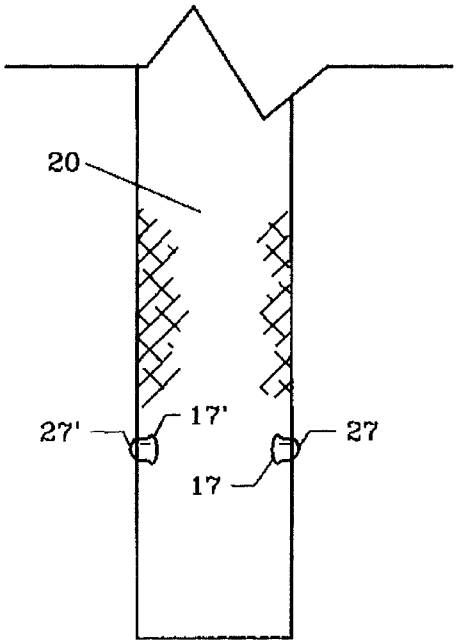
FIG. 4 depicts a front view of a trouser leg with snap fasteners attached interiorly thereof to the sides of the trouser's leg for coupling with the restraining device.

Means 16, 16' which may be snap fasteners are affixed to respectively, elastic end segments 15, 15' for fastening to means 17, 17' affixed to trouser leg 20 as shown in FIG. 4. Means 17, 17' can also be conventional "snap" fasteners although other types of fastening means may be employed. Link chains 12, 12' are adjustably joined to laynard hooks 24, 24' for each trouser leg and provide an excess amount of chain 25, 25' as seen in FIG. 3. This excess chain can support a decorative charm 26' as shown or other charm designs of the wearer's choice. Charms are usually only used on the exterior side of the boot opposite the other foot. In certain uses excess chain length 25 may not be suitable and can be removed as desired.

In FIG. 3, trouser leg 20 is shown with restraining device 10 connected beneath boot 19. Boot 19 will protect the foot and leg of the wearer from burns as may occur if hot parts of a motorcycle are inadvertently touched. Link chain 12 likewise would not be damaged by hot motorcycle parts since link chain 12 is made of a metal such as steel, gold, silver or the like.

In FIG. 4, a partial front view of a bottom of one leg of trousers not being worn such as blue jeans is shown whereby fasteners 17, 17' are depicted on the interior thereof, on opposite sides. While only one leg is shown, it is understood that both legs of the trousers would have means to fasten restraining device 10 thereto. When fasteners 17, 17' are snap type fasteners the back face of the fastener 27, 27' that is exposed on the outside of the trouser may be colored or display a logo.

The placement of the link chains 12, 12' between central elastic strap 11 and both elastic end segments 15, 15' provides for maximum strap protection from hot motorcycle parts while riding a motorcycle or use in a western ranch environment. This also allows for central elastic strap 11 to be hidden from sight by being underneath and in contact with the boot or shoe sole, while maximizing the appealing rough and heavy duty appearance of the chain against the boot or shoe. Metal chain segments are resistant to wear from the adverse condition of riding a motorcycle where as a normal fabric would succumb to the harmful effects of rubbing against hot and vibrating motorcycle parts. This added durability of the chains is advantageous for use in a western ranch environment common to cowboys and like. Such configuration allows for adjustment of retaining device 10 length on both sides of the boot to allow the wearer to adjust both sides to achieve the wanted appearance and chain coverage of the boot.

The attachment of chain lengths 12, 12' to key rings 13, 13' of elastic end segments 15, 15' by means of lanyard hooks 24, 24' allows for excess chain links 25, 25' to be used for hanging decorative charm 26' therefrom.

The illustrations and examples provided herein are for explanatory purposes and other configuration, materials, charm design and the like can be employed and the embodiment depicted are not intended to limit the scope of the appended claims.

I claim:

1. A restraining device for a trouser leg comprising: a central elastic strap, a pair of link chains, one each of said link chains affixed at each end of said elastic strap, a pair of elastic end segments, one each of said elastic end segments attached to each of said link chains and a pair of means for fastening said restraining device to said trouser leg, one each of said fastening means attached to one each of said elastic end segments.

2. The restraining device as claimed in claim 1 and including an openable key ring connector, said key ring connector joined to one of said elastic end segments and to one of said link chains.

3. The restraining device as claimed in claim 1 and including an openable key ring connector, said key ring connector joined to one end of said central elastic strap and to one end of one of said link chains opposite one of the elastic end segments.

4. The restraining device as claimed in claim 1 wherein said fastening means comprises a snap.

5. The restraining device as claimed in claim 1 wherein said link chain comprises a metal link chain.

6. The restraining device as claimed in claim 1 wherein said elastic end segments form a folded fabric loop.

7. The restraining device as claimed in claim 1 wherein said elastic strap is formed from an elastic fabric.

8. The restraining device as claimed in claim 1 and including a charm, said charm joined to one of said link chains.

9. A system for restraining a trouser leg to assist the trouser leg in returning to its fully extended position along the wearer's leg while providing aesthetic appeal comprising in combination: a pair of first fasteners, said first fasteners affixed to the bottom of said trouser leg interiorly on opposite sides thereof, and a restraining device for placement beneath the foot of the wearer, said restraining device comprising: a central elastic strap, a pair of link chains, one each of said link chains affixed at each end of said elastic strap, a pair of elastic end segments, one each of said pair of end segments attached to each of said link chains, a pair of second fasteners, said second fasteners attached to one each of said pair of end segments, each of said second fasteners for engaging one of said first fasteners to maintain said trouser leg in a fully extended posture along the wearer's leg.

10. The system of claim 9 and including a lanyard hook, said lanyard hook connected between one of said link chains and one of said elastic end segments.

11. The system of claim 9 and including a charm, said charm joined to one of said link chains.

* * * * *